US007040452B2

(12) United States Patent
Gunacker et al.

(10) Patent No.: US 7,040,452 B2
(45) Date of Patent: May 9, 2006

(54) DEVICE FOR DISTRIBUTING LUBRICANTS IN GROOVED RAILS

(76) Inventors: Richard Gunacker, Hauptstreet 21, A-3013, Tullnerbach (AT); Christian Gunacker, Hauptstreet 21, A-3013, Tullnerbach (AT)

( * ) Notice: Subject to any disclaimer, the term of this patent is extended or adjusted under 35 U.S.C. 154(b) by 0 days.

(21) Appl. No.: 10/090,868

(22) Filed: Mar. 7, 2002

(65) Prior Publication Data

US 2002/0166728 A1 Nov. 14, 2002

(51) Int. Cl.
*B61K 3/00* (2006.01)

(52) U.S. Cl. ..... 184/3.1

(58) Field of Classification Search ..... 184/3.1
See application file for complete search history.

(56) References Cited

U.S. PATENT DOCUMENTS 764,108 A * 7/1904 Brewer ..... 246/441
849,966 A * 4/1907 Blank ..... 184/3.1
1,205,711 A * 11/1916 Clark ..... 184/3.1
1,728,412 A * 9/1929 Humphries et al. ..... 184/3.1
1,810,764 A * 6/1931 Hamilton ..... 184/3.1
1,831,313 A * 11/1931 McGarry ..... 184/3.1
1,880,672 A * 10/1932 Bates et al. ..... 184/3.1
1,918,146 A * 7/1933 Stern ..... 184/3.1
1,979,447 A 11/1934 Butcher et al. ..... 184/3.1
2,016,975 A * 10/1935 Stern ..... 184/3.1
2,173,654 A * 9/1939 Moore ..... 184/3.1
2,907,410 A * 10/1959 Stokes ..... 184/3.1
4,214,647 A * 7/1980 Lutts ..... 184/3.1
5,394,958 A * 3/1995 Junk et al. ..... 184/3.1
5,609,294 A * 3/1997 Lucas, Jr. ..... 238/9
5,641,037 A 6/1997 Wise et al. ..... 184/3.1

FOREIGN PATENT DOCUMENTS

DE 508 130 9/1930

* cited by examiner

*Primary Examiner*—Chong H. Kim
(74) *Attorney, Agent, or Firm*—Reed Smith LLP

(57) ABSTRACT

The invention is directed to a device for distributing lubricants in grooved rails, particularly for railborne urban traffic. An elongated plate is provided which can be arranged in the groove of the rail and which is provided with cutouts at least along one longitudinal edge, but preferably along both longitudinal edges. The cutouts start at the longitudinal edge and are accordingly open-edged. The lubricant can be supplied to these cutouts. The open-edged cutouts of the plate are covered by a cover plate which is constructed so as to be elastic at least in the covering area.

8 Claims, 5 Drawing Sheets

DEVICE FOR DISTRIBUTING LUBRICANTS IN GROOVED RAILS

CROSS-REFERENCE TO RELATED APPLICATIONS

This application claims priority of Austrian Application No. A 423/2001, filed Mar. 16, 2001, the complete disclosure of which is hereby incorporated by reference.

FIELD OF THE INVENTION

The invention is directed to a device for distributing lubricants in grooved rails, particularly for railborne traffic. One of the main problems with devices of this type is distributing the lubricant on the groove wall uniformly while simultaneously preventing clogging of the distributing device.

OBJECT AND SUMMARY OF THE INVENTION

To solve this problem, the object of the invention is to provide an elongated plate which can be arranged in the groove of the rail and which is provided with cutouts at least along one longitudinal edge, but preferably along both longitudinal edges, which cutouts start at the longitudinal edge and are accordingly open-edged, the lubricant being supplied to these cutouts. It is further suggested that the open-edged cutouts of the plate are covered by a cover plate which is preferably constructed so as to be elastic at least in the covering area.

In the device according to the invention, the lubricant is applied to the inner wall of the groove by way of each of the cutouts which are cut into the lateral edges of the plate. A uniform distribution of lubricant can be achieved corresponding to the quantity of cutouts. When using a cover plate which is elastic in the covering area of the cutouts, this plate acts like a closing valve. This prevents any foreign bodies or contaminants from entering the cutouts.

In a further development of the invention, it can be provided that the cover plate which is constructed so as to be elastic in the area in which it covers the open-edged cutouts is covered by a substantially I-shaped plate. The width of the web of this I-shaped plate corresponds to the minimum distance between the open-edged cutouts of the plate having the open-edged cutouts located opposite one another. When the cover plate is constructed as a thin plate and is highly elastic, this cover plate is held down by the I-plate at those places where elasticity is not required for lifting up from the open-edged cutouts.

For purposes of a uniform delivery of the lubricant proceeding from a feed location for feeding a plurality of lubricant delivery openings, which need not necessarily be constructed as open-edged cutouts as described above, a lubricant feed device can be provided. This lubricant feed device is characterized in that it has a plurality of plates which can be fixed in the groove of the rail, particularly at the base of the groove, one on top of the other as a stack, the lowest or bottom plate of the plates that are placed one upon the other being provided with a flow divider which is preferably constructed as an elongated cutout in the plate. A feed opening for the lubricant preferably opens into the flow divider, preferably in the center, and the flow divider communicates, via at least two openings which are at a distance from one another, with flow dividers which are arranged in another plate of the stack of plates that are placed one upon the other, and the plate having the additional flow dividers is followed in the stack by a plate which communicates, via through-openings, with the flow divider or flow dividers and which can also be connected to lubricant delivery openings and which covers the flow divider or flow dividers. The flow dividers which are provided according to the invention divide a single supplied flow into a quantity of partial flows corresponding to the quantity of lubricant delivery openings. In the embodiment form which is shown by way of example, two partial flows can be formed initially from the single supplied flow, these two partial flows then being subdivided into additional partial flows, for example, eight partial flows, each of which supplies lubricant to a lubricant delivery opening.

In a preferred embodiment form, the flow divider or flow dividers arranged in the other plate is or are constructed as a recess or depression, particularly an I-shaped depression, in the plate. The openings for supplying lubricant to the flow dividers are constructed as holes in the base of the depression. However, the flow dividers in the other plate can also be constructed as holes, particularly I-shaped holes, in the other plate. The plate is covered on one side by a base which is fixedly connected to it and which bridges the holes and is provided with the through-openings for the lubricant which open into the holes of the plate. The hole in the other plate can then be produced, for example, by a punching process.

According to another embodiment form, when the flow dividers are formed as depressions or holes which are I-shaped as seen from above, as was described in the preceding, the through-openings which join the flow dividers in the other plate with the lubricant delivery openings lie above the flanges of the I-shaped flow dividers. A pair of through-openings is preferably allocated to each flange. In this case, each of these through-openings opens into one of the cutouts which are cut into the longitudinal edges of the plate and which form the lubricant delivery openings. In this case, the lubricant is also distributed transverse to the longitudinal extension of the lubricating device in the area of the flanges. In this respect, the I-shaped depressions or holes act, in practice, as distributing chambers for the lubricant. The total height of the lubricating device is conceived in such a way that the wheel running on the rail does not come into contact with the lubricating device when rolling over it. The total height should therefore not exceed about 14 mm. The lubricating device itself is preferably fixed to the groove base by means of screws.

Another construction of the device according to the invention is characterized in that a nipple which is provided with an outer or male cone is inserted, preferably screwed, into the feed opening of the bottom plate and in that the male cone projects into a through-opening which opens into the groove of the rail. Another nipple which is provided with an inner or female cone corresponding to the male cone is inserted, preferably screwed, into this through-opening, this female cone tightly contacting the male cone. This construction makes it possible to pull the entire insert provided for lubricating the groove out of the groove by loosening the screws. The nipple inserted into the feed opening of the bottom plate is pulled out along with it and contact is broken with the female cone of the nipple inserted into the rail.

The invention will be described more fully in the following by way of example with reference to the drawings.

DESCRIPTION OF THE PREFERRED EMBODIMENTS

Figure 5:
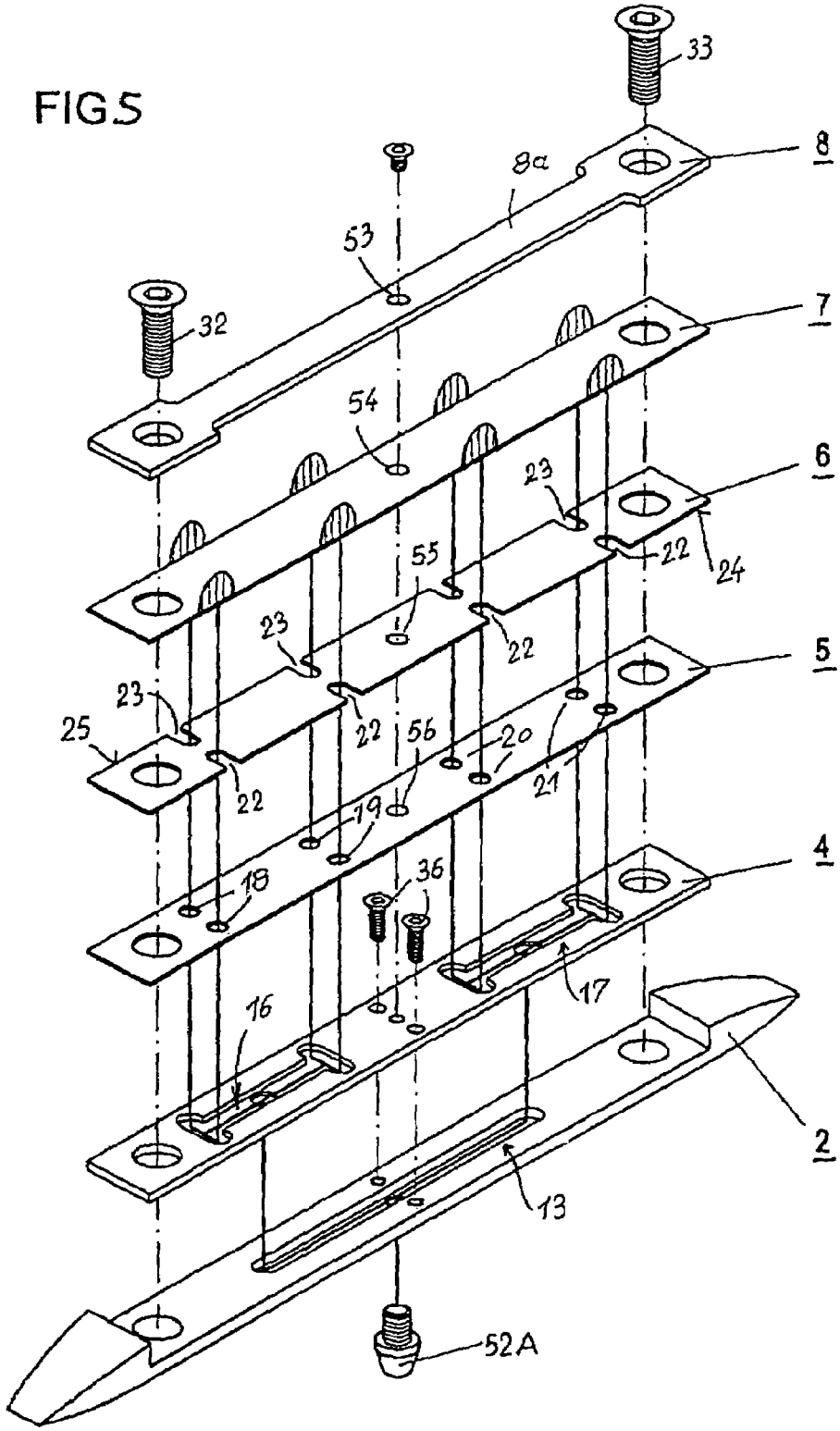
FIG. 5 shows an exploded view of the distributing device shown in FIG. 4 but in modified form in relation to FIG. 4, showing the course of the lubricant flow.

A grooved rail is designated by 1 in the drawing. A device for distributing lubricants is fastened, e.g., by means of screws 32, 33, in this grooved rail. The screws 32, 33 are screwed into the base 11 of the groove 10. The distributing device has an elongated plate 6 which can be arranged in the groove 10 of the rail 1 and which is provided, at least along one longitudinal edge, but preferably along both longitudinal edges 24, 24 as is shown in the drawing, with cutouts 22, 23 which are cut into the longitudinal edge and are accordingly open-edged. The lubricant is fed to these cutouts 22, 23 as shown in FIG. 5. The open-edged cutouts 22, 23 of the plate 6 are covered by a cover plate 7 which is preferably constructed so as to be elastic at least in the covering area. Accordingly, in the area of the open-edged cutouts 22, 23, the plate 7 or the longitudinal edge area of the plate 7 guides the lubricant against the wall of the groove. This can be seen from FIG. 5. The cover plate 7 is covered in turn by an essentially I-shaped plate 8. This plate has a web 8*a* whose width (s) corresponds to the minimum distance (a) between the open-edged cutouts 22, 23 of the plate 6 which are located opposite one another.

When the cover plate 7 is constructed so as to be elastic at least in the area in which this plate 7 covers the open-edged cutouts 22, 23, it acts as a valve plate which lifts up from the open-edged cutouts 22, 23 to a varying extent depending on pressure conditions and thus directs the lubricant flow to the groove wall of the rail at different heights. Further, the plate 7 also prevents contaminants from penetrating into the open-edged cutouts 22 and 23, since it covers them at the top. The plates 6 and 7 can be constructed as thin plates.

The feed device for the lubricant which is formed in the embodiment example by plates 2, 4 and 5 has a cutout 13 in the bottom plate (base plate) 2 of the plates 2, 4 and 5 which are stacked one on top of the other, this cutout 13 extending in longitudinal direction of the plate 2. A feed opening 12 for the lubricant opens into the cutout 13 of the bottom plate 2. The plate 4 following the bottom plate 2 in the stack 9 formed from the plates 2, 4, 5 lying on top of one another has at least two through-openings 14, 15 which are arranged above the cutout 13 of the bottom plate 2 in the stack 9 and accordingly communicate with the cutout 13 of the bottom plate 2. The cutout 13 causes the flow of lubricant to be divided in longitudinal direction of the bottom plate 2 from the center of the cutout 13 in the direction of the ends of the cutout 13.

The plate 4 can be screwed to the bottom plate 2 by means of countersunk head screws 36 which penetrate bore holes 40 in the plate 4 and are screwed into threaded bore holes 48 in the bottom plate 2.

Plates 5, 6, 7 and 8 can be connected with the plate 4, which has been connected to the bottom plate 2 beforehand by means of screw 36 as was described above, by means of a screw 34 which penetrates bore holes 53–56 in the plates 8, 7, 6 and 5 and is screwed into a threaded bore hole 35 in the plate 4.

Figure 1:
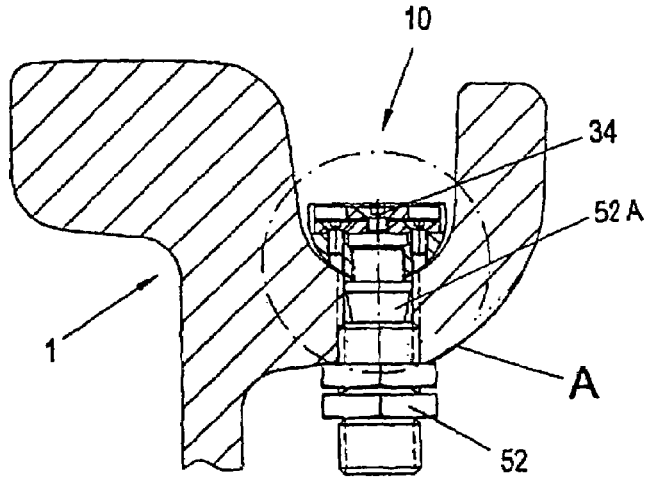
FIG. 1 shows a cross section (along line I—I in FIG. 3) through the head of a grooved rail which is provided with a distributing device, according to the invention, for distributing lubricant.
Figure 1A:
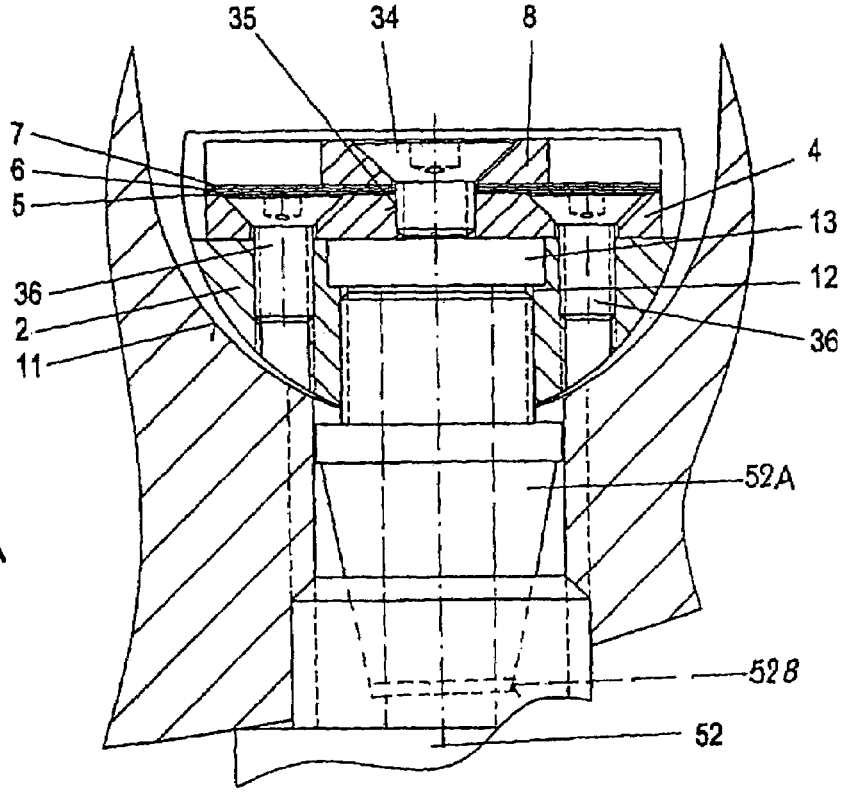
FIG. 1A shows detail A in a larger scale compared to FIG. 1.
Figure 2:
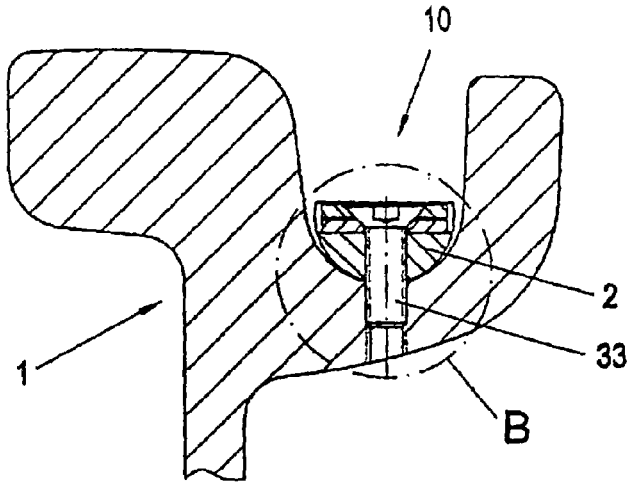
FIG. 2 shows a section (along line II—II in FIG. 3) similar to that shown in FIG. 1 through a grooved rail but, in this case, through the fastening of the distributing device in the groove of the rail.
Figure 2B:
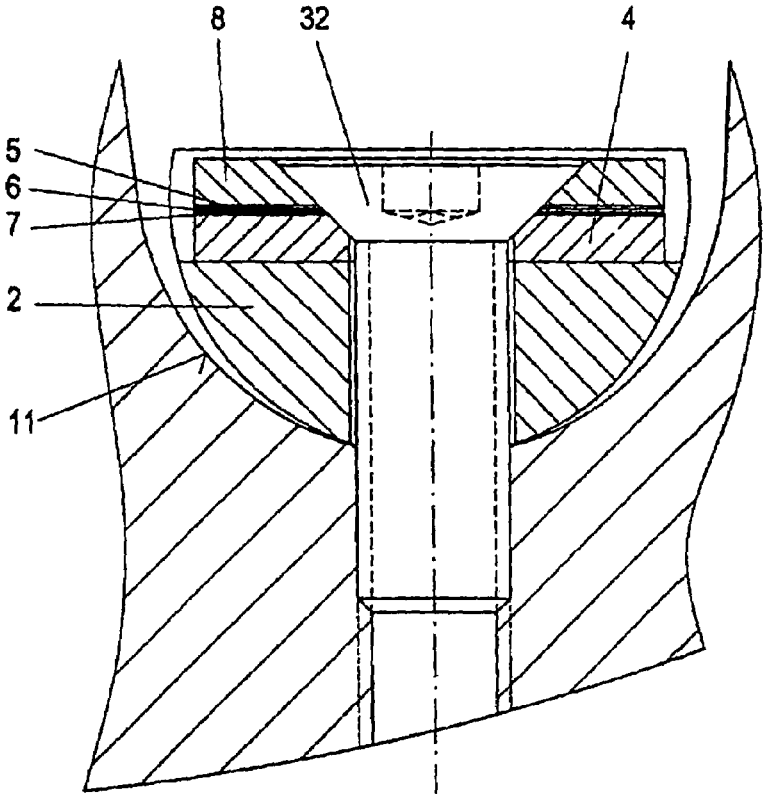
FIG. 2B shows detail B from FIG. 2 in a larger scale compared to FIG. 2.
Figure 3:
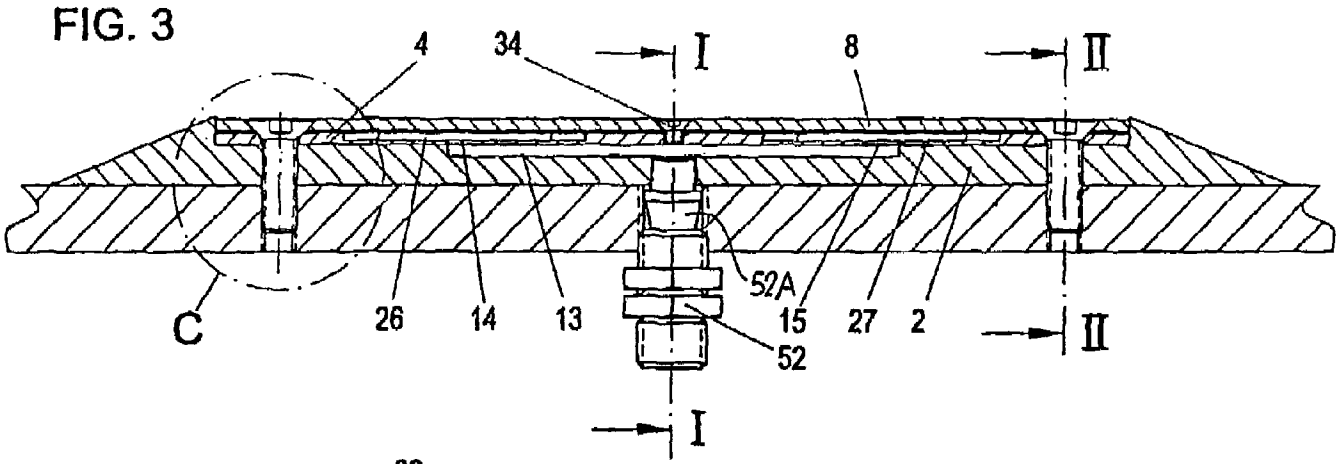
FIG. 3 shows a longitudinal section through the grooved rail provided with a distributing device according to the invention.
Figure 3C:
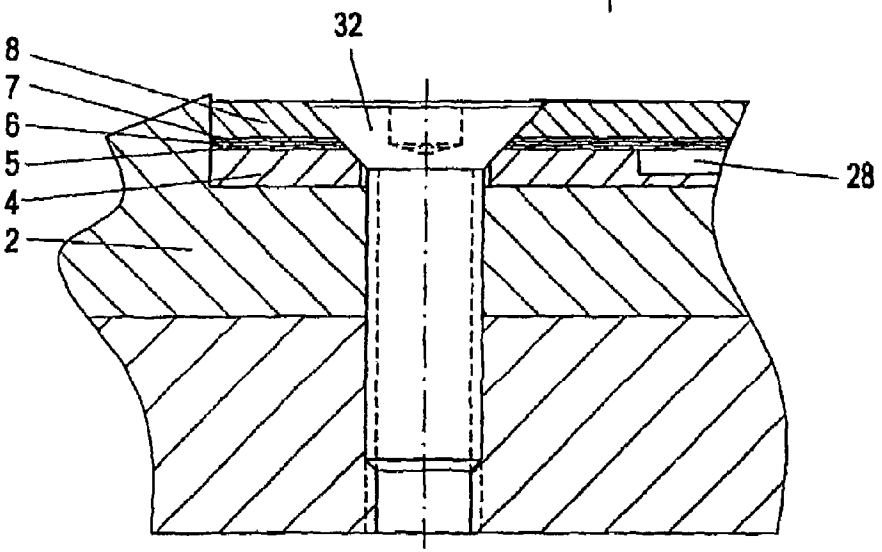
FIG. 3C shows detail C from FIG. 3 in a larger scale compared to FIG. 3.
Figure 4:
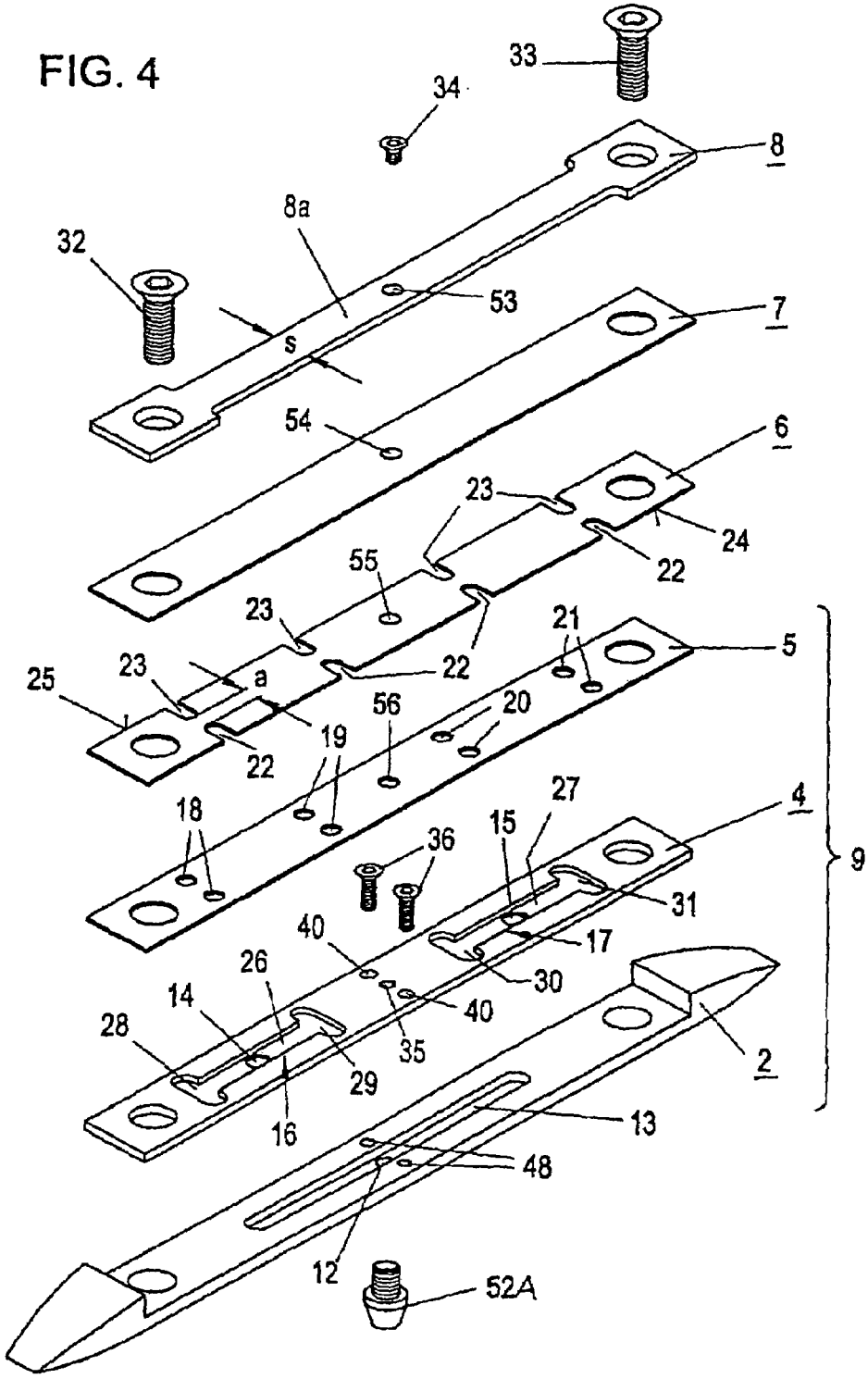
FIG. 4 shows an exploded view of a distributing device constructed according to the invention.

In the example shown in the drawing, plates 2, 4 and 5 form a stack 9 (a component assembly) through which the cutouts 22, 23 proceeding from the edges 24, 25 in the plate 6 are provided with lubricant in partial flows corresponding to the quantity of cutouts 22, 23. The lubricant is supplied through a nipple 52 which can be connected to a separate (hose) line and which is screwed into the rail 1 from the bottom and has a female cone (FIGS. 1, 1A), A cone nipple 52A which has a male cone matching the female cone of nipple 52 which is screwed into the rail 1 is screwed into the feed opening 12 of the bottom plate 2 (FIGS. 1, 1A). When the entire package (2, 4, 5, 6, 7, 8) is screwed into the rail by the fastening screws 32 and 33, the female cone of the nipple 52 joins with the male cone of the nipple 52A in a tight connection.

The distributing device for the lubricant which is formed by plates 6, 7 and 8 in the present embodiment example and the device for feeding lubricant to the lubricant delivery openings (open-edged cutouts 22, 23) which is formed in the embodiment example by the plates 2, 4 and 5 that are placed one upon the other can be screwed into the groove 10 of the rail by screws 32 and 33.

The feed device (plates 2, 4 and 5) could also be fastened as a unit in the groove 10 of the rail 1 and the distributing device for the lubricant (plates 6, 7, 8) could be placed on this unit and fastened to the feed device, for example, by screws. The flow dividers 16, 17 arranged in the plate 4 are formed as an I-shaped depression in the present embodiment example. An opening 14 and 15, respectively, through which the lubricant is fed to the flow dividers 16 and 17, respectively, is located in the base of the web of the I-shaped depressions of every flow divider 16, 17. The lubricant flows along the web 26, 27 of the I-shaped depression against the two flanges 28, 29 and 30, 31, respectively, of the I-shaped depressions and also fills the flanges 28, 29 and 30, 31, respectively, from which it arrives at the lubricant delivery openings 22, 23 via through-openings 18, 19, 20, 21 in a plate 5 covering the plate 4. The through-openings 18, 19, 20, 21 in the plate 5 lie above the flanges 28, 29 and 30, 31, respectively, of the flow dividers 16, 17.

Instead of providing I-shaped depressions 16, 17 in the plate 4, I-shaped punched out portions could also be provided in the plate 4 and covered on one side by a separate base which is detachably or permanently connected with the plate 4. In this case, the base is provided with openings 14, 15 which open into the I-shaped punched out portions from which the lubricant then arrives at the lubricant delivery openings through the through-openings 18, 19, 20 and 21 of the plate 5.

The invention claimed is:

1. A device for distributing lubricants in grooved rails, comprising:

an elongated plate adapted to be arranged in the groove of the rail and having a plurality of cutouts at least along one longitudinal edge, said cutouts starting at the longitudinal edge and being open-edged, the lubricant being supplied to said cutouts so that the lubricant flows out through the open edges of said cutouts, and wherein the open-edged cutouts of the elongated plate are covered by a cover plate which is constructed so as to be elastic at least in the covering area wherein the elongated plate has cutouts on two opposing long edges, and wherein the cover plate which is constructed so as to be elastic in the area in which it covers the open-edged cutouts is covered by a substantially I-shaped plate, wherein the width(s) of the web of this I-shaped plate substantially covers the minimum distance between the open-edged cutouts of the plate having the open-edged cutouts located opposite one another.

2. The device according to claim 1, further comprising a feed device having a plurality of plates fixed in the groove of the rail, one on top of the other as a stack;

wherein the bottom plate of the plates is provided with a first flow divider which is constructed as an elongated cutout in the plate;

wherein a feed opening for the lubricant opens into the first flow divider;

said first flow divider communicates, via at least two openings which are at a distance from one another, with second flow dividers which are arranged in another plate of the stack of the plates; and wherein the plate having the second flow dividers is followed in the stack by a plate which communicates, via through-openings, with the second flow dividers and which can also be connected to the lubricant delivery openings and which covers the second flow dividers of the plate.

3. The device according to claim 2, wherein the second flow dividers are formed as I-shaped depressions, in the plate on which the second flow dividers are arranged, wherein the openings for feeding the lubricant to the flow dividers are formed as holes in the base of the depression.

4. The device according to claim 2, wherein the flow dividers arranged in the other plate are formed as an I-shaped hole, in the another plate, wherein the plate is covered on one side by a base which is fixedly connected to it and which bridges the holes and is provided with the through-openings for the lubricant which open into the holes of the plate.

5. The device according to claim 3, wherein when the second flow dividers are formed in an I-shaped manner, the through-openings which join the flow dividers in the plate with the lubricant delivery openings lie above the flanges of the I-shaped flow dividers, wherein a pair of through-openings is allocated to each flange, and wherein each of these through-openings opens into one of the cutouts which are cut into the longitudinal edges of the plate and which form the lubricant delivery openings.

6. The device according to claim 2, wherein a nipple which is provided with a male cone is inserted, into the feed opening of the bottom plate, and wherein the male cone projects into a through-opening which opens into the groove of the rail, another nipple which is provided with a female cone corresponding to the male cone being inserted, into this through-opening, and wherein the female cone tightly contacts the male cone.

7. The device according to claim 1, wherein the elongated plate has a plurality of cutouts along two opposite longitudinal edges.

8. The device according to claim 1, wherein the elongated plate has a plurality of U-shaped cutouts along two opposite longitudinal edges.

* * * * *